US010041304B2

(12) United States Patent
Saini et al.

(10) Patent No.: US 10,041,304 B2
(45) Date of Patent: Aug. 7, 2018

(54) POLYCRYSTALLINE DIAMOND COMPACTS AND METHODS OF MANUFACTURE

(71) Applicant: Halliburton Energy Services, Inc., Houston, TX (US)

(72) Inventors: Gagan Saini, Conroe, TX (US); William Brian Atkins, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 227 days.

(21) Appl. No.: 14/905,099

(22) PCT Filed: Mar. 10, 2015

(86) PCT No.: PCT/US2015/019577

§ 371 (c)(1),
(2) Date: Jan. 14, 2016

(87) PCT Pub. No.: WO2016/144325

PCT Pub. Date: Sep. 15, 2016

(65) Prior Publication Data

US 2017/0107768 A1 Apr. 20, 2017

(51) Int. Cl.

| | |
|---|---|
| ***E21B 10/56*** | (2006.01) |
| ***E21B 10/573*** | (2006.01) |
| ***C22C 1/00*** | (2006.01) |
| ***B22F 7/06*** | (2006.01) |
| ***C22C 26/00*** | (2006.01) |

(Continued)

(52) U.S. Cl.

CPC ..... *E21B 10/5735* (2013.01); *B22F 7/06* (2013.01); *B24D 18/0009* (2013.01); *C22C 1/00* (2013.01); *C22C 26/00* (2013.01); *E21B 10/55* (2013.01); *B22F 2998/10* (2013.01)

(58) Field of Classification Search

CPC ..... E21B 10/46; E21B 10/56; E21B 10/5735
See application file for complete search history.

(56) References Cited

U.S. PATENT DOCUMENTS 4,605,343 A * 8/1986 Hibbs, Jr. ..... B24D 99/00 125/39
5,310,596 A * 5/1994 Bigelow ..... C23C 16/26 428/212

(Continued)

FOREIGN PATENT DOCUMENTS

WO 2011081924 A1 7/2011
WO 2012044568 A2 4/2012

OTHER PUBLICATIONS

International Search Report and Written Opinion for PCT/US2015/019577 dated Nov. 26, 2015.

*Primary Examiner* — Kenneth L Thompson
(74) *Attorney, Agent, or Firm* — McDermott Will & Emery LLP

(57) ABSTRACT

An example polycrystalline diamond compact includes a substrate and a diamond table attached to the substrate. A multilayer joint interposes the substrate and the diamond table and comprises at least two component parts selected from the group consisting of a base layer, one or more intermediate layers, and a braze layer. The at least two component parts are formed via a thin film deposition process.

15 Claims, 4 Drawing Sheets

(51) Int. Cl.
*B24D 18/00* (2006.01)
*E21B 10/55* (2006.01)

(56) References Cited

U.S. PATENT DOCUMENTS

| | | | | |
|---|---|---|---|---|
| 5,435,815 | A * | 7/1995 | Ikegaya | B23P 15/28 51/295 |
| 5,647,878 | A | 7/1997 | Iacovangelo et al. | |
| 5,762,660 | A * | 6/1998 | Makowiecki | B24B 3/00 51/295 |
| 8,061,454 | B2 | 11/2011 | Voronin et al. | |
| 8,763,730 | B2 * | 7/2014 | Cariveau | B22F 7/08 175/425 |
| 8,821,604 | B2 * | 9/2014 | Sani | B22F 7/06 175/428 |
| 8,986,406 | B2 * | 3/2015 | Petree | B22F 7/06 51/297 |
| 9,662,769 | B2 * | 5/2017 | Sue | C22C 26/00 |
| 9,719,308 | B2 * | 8/2017 | Scott | E21B 10/567 |
| 2006/0086540 | A1 * | 4/2006 | Griffin | E21B 10/567 175/428 |
| 2009/0173547 | A1 | 7/2009 | Voronin et al. | |
| 2010/0108403 | A1 * | 5/2010 | Keshavan | C22C 26/00 175/428 |
| 2011/0297454 | A1 | 12/2011 | Shen et al. | |
| 2012/0181090 | A1 | 7/2012 | Qian et al. | |
| 2013/0068539 | A1 | 3/2013 | Vempati et al. | |
| 2014/0215926 | A1 | 8/2014 | Miess et al. | |

* cited by examiner

POLYCRYSTALLINE DIAMOND COMPACTS AND METHODS OF MANUFACTURE

BACKGROUND

Wellbores for the oil and gas industry are commonly drilled by a process of rotary drilling. In conventional wellbore drilling, a drill bit is mounted on the end of a drill string, which may be several miles long. At the surface of the wellbore, a rotary table or top drive turns the drill string, including the drill bit arranged at the bottom of the hole to increasingly penetrate the subterranean formation, while drilling fluid is pumped through the drill string. In other drilling configurations, the drill bit may be rotated using a mud motor arranged axially adjacent the drill bit in the downhole environment and powered using the circulating drilling fluid.

One common type of drill bit used to drill wellbores is known as a "fixed cutter" or "drag" bit. A fixed cutter drill bit generally includes a bit body formed from a high strength material and a plurality of cutters attached at selected locations about the bit body. Cutters on fixed cutter drill bits often include a substrate or support stud made of carbide (e.g., tungsten carbide), and a cutting surface layer or "diamond table," which can be made of polycrystalline diamond. Such cutters are commonly referred to as polycrystalline diamond compact ("PDC") cutters.

Various methods for securing diamond materials to a substrate have been actively investigated. Often, diamond is simultaneously formed and bonded to a substrate using a single high-temperature, high-pressure (HTHP) press cycle. However, this method conventionally uses a so-called catalyzing material, such as cobalt, to facilitate bonding between the diamond particles and between the as-formed diamond and the substrate. The presence of residual catalyzing material in the diamond can result in reduced thermal stability, so PDC cutters are often leached to remove residual cobalt from the working surface. In other cases, instead of attaching the diamond to the substrate in the press, PDC may first be formed and then attached to the substrate, such as by brazing using an active metal braze alloy.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present application is related to downhole tools and, more particularly, to polycrystalline diamond compacts, such as cutters and bearing elements, and methods of manufacturing polycrystalline diamond compacts that have a multilayer joint.

Embodiments of the present disclosure relate to the attachment of a diamond table or "disk" to a substrate to form a polycrystalline diamond compact for an earth-boring drill bit. The diamond table may be coupled to the substrate using a multilayer joint created using a thin film deposition process, such as sputtering or chemical vapor deposition. The deposition process results in the generation of one or more thin, metallic films that enhance the joining strength of the diamond table to the substrate. Moreover, the materials used during the deposition process may be selected to better managing residual stresses and coefficient of thermal expansion mismatch between the diamond table and the substrate. The thin film deposition process may be undertaken at relatively low temperatures that minimize residual stresses at the joint between the diamond table and the substrate. As a result, the thermo-mechanical integrity and abrasion resistance of the polycrystalline diamond compact may be improved, thereby minimizing failure at the joint. The polycrystalline diamond compact may comprise a cutter or a bearing element used in the drill bit.

Figure 1A:
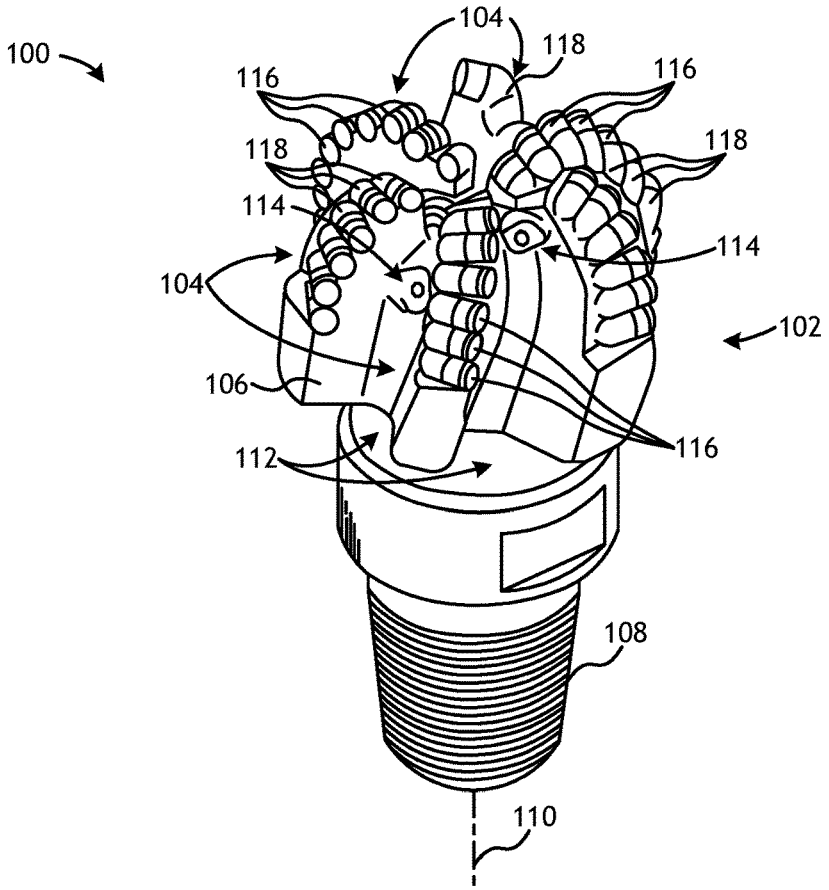
FIG. 1A is an isometric schematic drawing of an exemplary fixed-cutter drill bit that may employ the principles of the present disclosure.

FIG. 1A is an isometric view of an exemplary fixed-cutter drill bit 100 that may employ the principles of the present disclosure. The drill bit 100 has a bit body 102 that includes radially and longitudinally extending blades 104 having leading faces 106, and a threaded pin connection 108 for connecting the bit body 102 to a drill string (not shown). The bit body 102 may be made of steel or a metal matrix of a harder material, such as tungsten carbide. The bit body 102 is configured for rotation about a longitudinal axis 110 to drill into a subterranean formation via application of weight on the bit body 102. Corresponding junk slots 112 are defined between circumferentially adjacent blades 104, and a plurality of nozzles or ports 114 can be arranged within the junk slots 112 for ejecting drilling fluid that cools the drill bit 100 and flushes away cuttings and debris generated while drilling.

The bit body 102 further includes a plurality of cutters 116 each disposed within a corresponding cutter pocket 118 sized and shaped to receive the cutters 116. The cutters 116 are held in the blades 104 and corresponding cutter pockets 118 at predetermined angular orientations and radial locations to position the cutters 116 with a desired backrake angle against the formation being penetrated. As the bit body 102 is rotated, the cutters 116 are driven through the underlying rock by the combined forces of weight-on-bit and torque assumed at the drill bit 100.

Figure 1B:
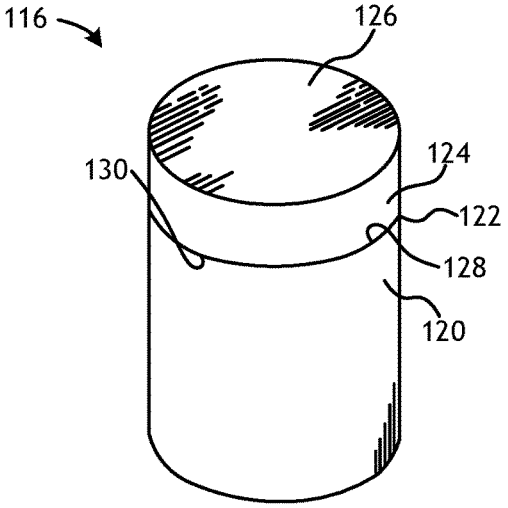
FIG. 1B is a schematic drawing of an exemplary cutter that may be used with the drill bit of FIG. 1A.

Referring now to FIG. 1B, with continued reference to FIG. 1A, illustrated is a plan view of one of the cutters 116 that may be used in the drill bit 100 of FIG. 1A. As illustrated, the cutter 116 may include a generally cylindrical substrate 120 and a diamond table 124 (alternatively referred to as a disk) coupled to the substrate 120 at an interface 122 between the substrate 120 and the diamond table 124. The substrate 120 may be made of an extremely hard material, such as cemented tungsten carbide (WC). In some embodiments, the substrate 120 may comprise a cylindrical WC "blank" that is sufficiently long to act as a mounting stud for the diamond table 124. In other embodiments, however, the substrate 120 may comprise an intermediate layer bonded at another interface to another metallic mounting stud, without departing from the scope of this disclosure.

The diamond table 124 may include one or more layers of an ultra-hard material, such as polycrystalline diamond (PCD), polycrystalline cubic boron nitride, impregnated diamond, or another super-abrasive material. In some embodiments, the diamond table 124 may be formed by subjecting particulate material to a high-temperature, high-pressure (HTHP) press cycle. In at least one embodiment, a material informally referred to in the art as a catalyst or catalyzing material, such as cobalt, may be provided to promote bonding between diamond particles during formation of the diamond table 124. Following the HTHP press cycle, in some embodiments, the diamond table 124 may be prepared for higher temperature resistance and/or higher wear/abrasion resistance. This can be achieved by removing the residual cobalt catalyst from the diamond table 124, such as through a leaching process, prior to bonding the diamond table 124 to the substrate that will be used to attach the resulting cutter to the drill bit. The resulting material of the leached diamond table 124 in that instance may be referred to as thermally stable polycrystalline (TSP) diamond.

In other embodiments, the TSP material may be produced without leaching, by forming the diamond with a non-cobalt catalyst during the HTHP press cycle. In such embodiments, a particulate mixture comprising grains of a hard material and a non-cobalt or carbonate catalyst material (e.g., a carbonate of one or more of magnesium, calcium, strontium, and barium) may be subjected to elevated temperatures (e.g., temperatures greater than about 2000° C.) and elevated pressures (e.g., pressures greater than about 7 GPa). This HTHP press cycle may result in the formation of inter-granular bonds between the particles of hard material, and thereby forming the inter-bonded grains of the TSP diamond material without the need for leaching. Accordingly, in at least one embodiment, the diamond table 124 may comprise TSP diamond, but may generally include any PCD that has been become thermally stable, whether leached or not. The as-formed diamond table 124 may subsequently be bonded to the substrate 120, as will be discussed below.

The resulting cutter 116 may be characterized and otherwise referred to herein as a "polycrystalline diamond compact." Indeed, any structure that includes a PCD table attached to a substrate may be characterized as a polycrystalline diamond compact. As described below, for example, another type of polycrystalline diamond compact includes a bearing element made from a PCD table attached to a substrate. Those skilled in the art will readily appreciate that any polycrystalline diamond compact may be fabricated using the methods described herein.

The diamond table 124 generally defines or provides a working surface 126, at least a portion of which engages the formation during drilling for cutting/failing the formation. In the orientation shown in FIG. 1B, the interface 122 between the diamond table 124 and the substrate 120 extends between a top surface 128 of the substrate 120 and a bottom surface 130 of the diamond table 124, where the bottom surface 130 is opposite the working surface 126. According to embodiments of the present disclosure, the diamond table 124 may be attached to the substrate 120 using a multilayer joint positioned at the interface 122. The multilayer joint may prove advantageous in helping to better manage residual stresses and coefficient of thermal expansion (CTE) mismatches between the diamond table 124 and the substrate 120. As a result, the thermo-mechanical integrity of the resulting cutter 116 may be improved, including an improvement in abrasion resistance for the cutter 116 during operation, and failure at the interface 122 may be minimized.

Figure 2:
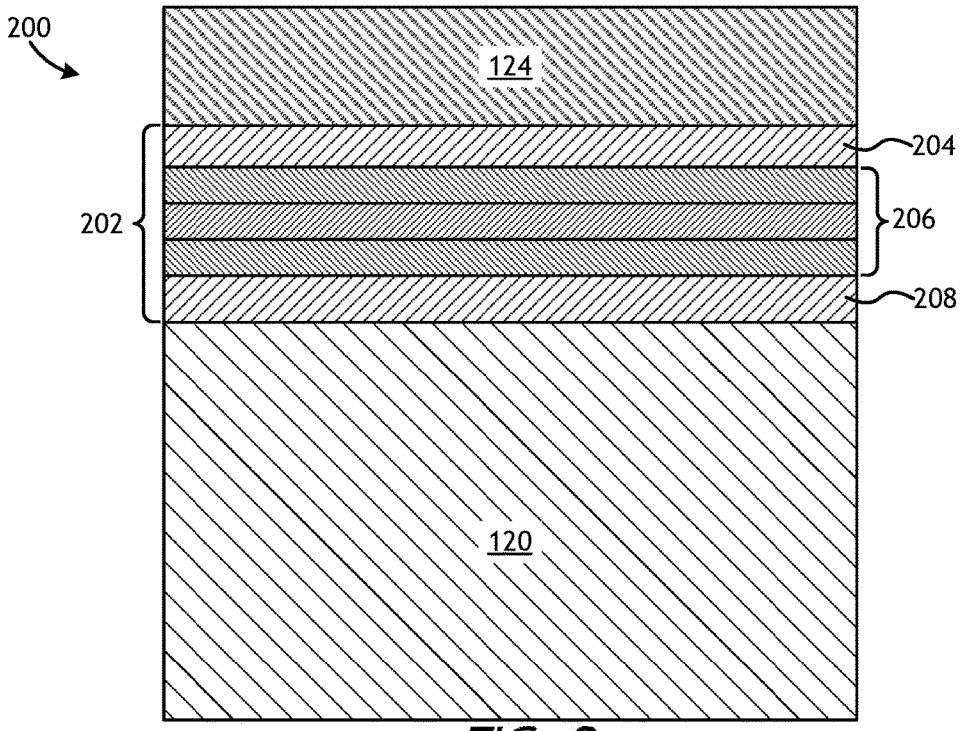
FIG. 2 is a cross-sectional schematic view of an exemplary cutter.

Referring now to FIG. 2, illustrated is a cross-sectional schematic side view of an exemplary cutter 200, according to one or more embodiments. The cutter 200 may be the same as or similar to the cutter 116 of FIG. 1B and therefore may be best understood with reference thereto, where like numerals represent like elements or components not described again. Similar to the cutter 116 of FIG. 1B, for example, the cutter 200 may include the diamond table 124 and the substrate 120. As illustrated, a multilayer joint 202 may be positioned at the interface 122 (FIG. 1B) between the diamond table 124 and the substrate 120 and may otherwise generally interpose the diamond table 124 and the substrate 120. The multilayer joint 202 may serve to attach the diamond table 124 to the substrate 120 such that the cutter 200 can be used for downhole operation.

In the illustrated embodiment, the multilayer joint 202 may include a base layer 204, one or more intermediate layers 206, and a braze layer 208. The base layer 204, the intermediate layer(s) 206, and the braze layer 208 may be collectively referred to herein as the component parts of the multilayer joint 202. Each component part may be formed or otherwise deposited using any chemical or physical thin film deposition technique known to those skilled in the art. Suitable thin film deposition processes that may be employed include, but are not limited to, physical vapor deposition, chemical vapor deposition, sputtering, pulsed laser deposition, chemical solution deposition, plasma enhanced chemical vapor deposition, cathodic arc deposition, electrohydrodynamic deposition (i.e., electrospray deposition), ion-assisted e-beam deposition, plating, thermal evaporation, and spin coating. The component parts of the multilayer joint 202 may be formed under high vacuum and/or inert atmosphere during the thin film deposition process.

In some embodiments, the component parts of the multilayer joint 202 may be sequentially deposited directly on the diamond table 124 during the thin film deposition process. In such embodiments, the diamond table 124 may be positioned within the deposition chamber of the particular thin film deposition technique and may serve as a type of substrate or carrier to build the multilayer joint 202. Following the deposition process, the diamond table 124, with the multilayer joint 202 deposited or otherwise formed thereon, may then be coupled or attached to the substrate 120 by brazing, which results in the formation of the cutter 200. In some embodiments, the brazing process may be undertaken under selective temperature and/or pressure parameters and in the presence of selective gases. As a result, the brazing process may incorporate and otherwise comprise vacuum brazing, hot pressing, and/or "lower" HPHT processes. Accordingly, in some embodiments, the cutter 200 may be formed through at least an initial HTHP press cycle that forms the diamond table 124, as generally described above (and optionally followed by a leaching process), and then a subsequent brazing operation that bonds the diamond table 124 to the substrate 120 using the multilayer joint 202.

In other embodiments, however, the multilayer joint 202 may be built up separate from the diamond table 124 using the thin film deposition process. In such embodiments, a separate carrier substrate may be positioned within the deposition chamber and the component parts of the multilayer joint 202 may be sequentially deposited on the carrier substrate during the thin film deposition process. Following the deposition process, the multilayer joint 202 may be detached from the carrier substrate as a free-standing multilayer film (sometimes referred to as "foil"). The multilayer joint 202 may then be positioned between the diamond table 124 and the substrate 120 and subsequently subjected to brazing to bonds the diamond table 124 to the substrate 120 using the multilayer joint 202 and thereby forms the cutter 200.

As illustrated, the base layer 204 may constitute the initial layer of the multilayer joint 202, i.e., the layer adjacent the diamond table 124 to directly contact the diamond table 124 (i.e., at the bottom surface 130 of FIG. 1B). The base layer 204 may be made of a variety of materials configured to form a chemical bond and/or carbide with the diamond table 124. Suitable materials for the base layer 204 include, but are not limited to, titanium, tungsten, chromium, zirconium, manganese, vanadium, yttrium, niobium, molybdenum, hafnium, tantalum, copper, silver, gold, nickel, palladium, boron, silicon, iron, aluminum, cobalt, indium, phosphorus, or any alloy thereof (e.g., a tungsten-titanium alloy). The foregoing materials may be characterized as being "active" or "non-active." "Active" materials are those that may react with the polycrystalline ultra-hard material, and "non-active" materials are those that do not necessarily react with the polycrystalline ultra-hard material. In some embodiments, the different materials used may be selected on the basis of the being active or non-active and/or on the basis of the melting (liquidus) temperatures and/or solidifying (solidus) or crystallizing temperatures of the given materials.

In some embodiments, the base layer 204 may be doped and/or infiltrated with one or more materials to enhance the bond to the diamond table 124 and/or manipulate the coefficient of thermal expansion (CTE) of the base layer 204. For instance, the material of the base layer 204 may be doped and/or infiltrated with a ceramic, a metal with high ductility or yield stress, a polymeric material, or a mixture or combination thereof. Suitable ceramics that may be used to dope the base layer 204 include, but are not limited to, tungsten carbide, diamond, nanodiamond, nanocarbon, graphene, carbon nanotubes, and the like. As will be appreciated, doping the base layer 204 with carbide formers may prove advantageous in cases where other elements may preferential bond or consume the carbide former prior to forming attachment to the diamond table 124. Suitable metals that may be used to dope the base layer 204 include, but are not limited to, copper, silver, gold, nickel, and any combination thereof.

The braze layer 208 may be a material layer adjacent the substrate 120 and may be configured to bond the multilayer joint 202 and, therefore, the diamond table 124, to the substrate 120 (i.e., at the top surface 128 of FIG. 1B). The braze layer 208 may be made of an inert, oxidation-resistant metal or metal alloy that can be brazed to the substrate 120 with little or no generation of oxides. Suitable materials for the braze layer 204 include, but are not limited to, silver, copper, gold, any alloy thereof, and any eutectic/non-eutectic combination thereof. Similar to the base layer 204, in some embodiments, the braze layer 208 may also be doped and/or infiltrated with various materials to enhance the bond to the substrate 120 and/or optimize the CTE of the braze layer 208. Suitable doping or infiltration materials are the same as listed above and, therefore, will not be listed again.

The one or more intermediate layers 206 may be configured to provide the multilayer joint 202 with optimal shear strength and minimal thermal stresses. While depicted in FIG. 2 as comprising three distinct material layers, the intermediate layers 206 may comprise any number of material layers, including only a single material layer, without departing from the scope of the disclosure. Moreover, in some embodiments, one of the base layer 204 or the braze layer 208 may form an integral part of, and otherwise be counted with the intermediate layers 206. Accordingly, in such embodiments, the multilayer structure 206 may comprise only two component parts, where one of the base layer 204 or the braze layer 208 are considered part of the intermediate layers 206. In one embodiment, for example, the multilayer structure 206 may comprise a base layer 204 and one or more intermediate layers 206, where the intermediate layers 206 include the braze layer 208 or, alternatively, the intermediate layer 206 comprises only the braze layer 208. In another embodiment, the multilayer structure 206 may comprise the braze layer 208 and one or more intermediate layers 206, where the intermediate layers 206 include the base layer 204 or, alternatively, the intermediate layer 206 comprises only the base layer 204.

The intermediate layer(s) 206 may be made of a variety of materials that exhibit a CTE that lies between that of the diamond table 124 and the substrate 120. For example, tungsten carbide exhibits a CTE ($10^{-6}/°$ K) of about 4.5 to about 6.5, diamond exhibits a CTE ($10^{-6}/°$ K) of about 1, and most metals exhibit a CTE ($10^{-6}/°$ K) of about 10 to about 20. Suitable materials for the intermediate layer(s) 206 include, but are not limited to, titanium, tungsten, chromium, zirconium, manganese, or any alloy thereof (e.g., a tungsten-titanium alloy, an iron-nickel alloy, Invar (64FeNi)). Similar to the base layer 204 and the braze layer 208, one or more of the intermediate layer(s) 206 may be doped and/or infiltrated with a material to manipulate the CTE of a given intermediate layer 206. Suitable doping or infiltration materials are the same as listed above and, therefore, will not be listed again. The composition, thickness, and number of intermediate layers 206 used in the multilayer joint 202 will depend on final joint thickness for providing optimal shear strength and minimal thermal stresses.

The materials used for any of the base layer 204, the intermediate layer(s) 206, and the braze layer 208 may be selected based on one or more critical properties of the materials, such as melting temperature, CTE, ductility, and corrosion resistance. As will be appreciated, the temperature of the deposited materials during the deposition process should generally be maintained lower than the graphitization temperature of the diamond table 124 to prevent graphitization of the diamond in the diamond table 124. Typical diamonds have temperature limit of approximately 800-1200° C. (depending on atmospheric conditions) for graphitization. The values are in the range 1000-1200° C. in vacuum for TSP diamond. In some cases, the graphitization temperature may depend, at least in part, on the atmosphere within the deposition chamber of the particular thin film deposition technique being employed.

Figure 3:
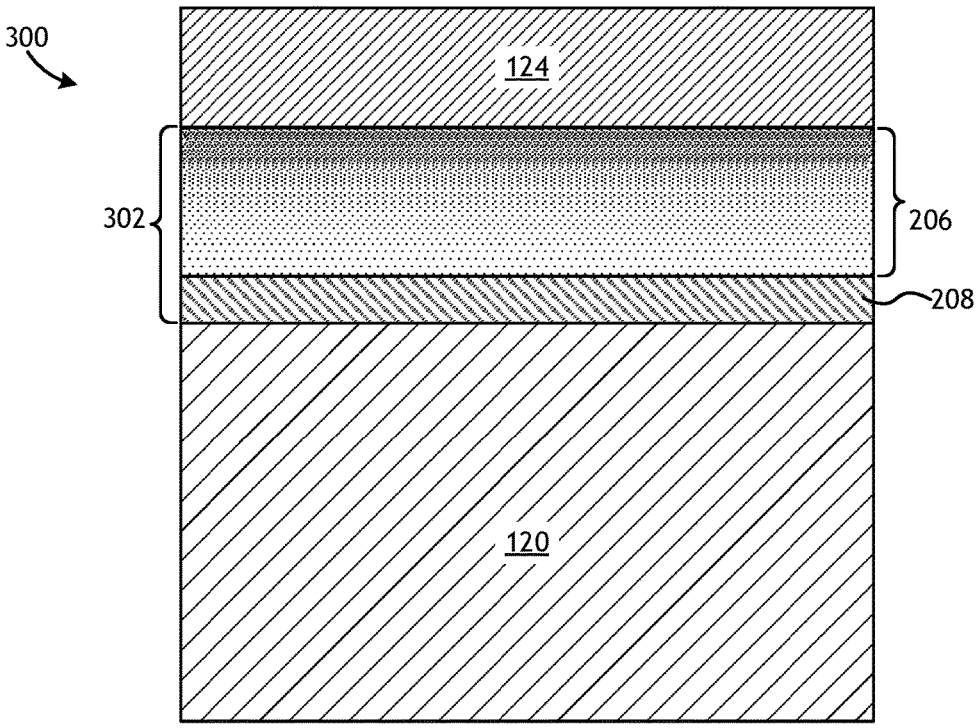
FIG. 3 is a cross-sectional schematic view of another exemplary cutter.

Referring now to FIG. 3, illustrated is a cross-sectional schematic side view of another exemplary cutter 300, according to one or more embodiments. The cutter 300 may be similar in some respects to the cutter 200 of FIG. 2 and therefore may be best understood with reference thereto. Similar to the cutter 200 of FIG. 2, for example, the cutter 300 may include the diamond table 124 and the substrate 120. Moreover, the cutter 300 may include a multilayer joint 302 that generally interposes the diamond table 124 and the substrate 120. Similar to the multilayer joint 202 of FIG. 2, the multilayer joint 302 may serve to couple or attach the diamond table 124 to the substrate 120 such that the cutter 300 can be used for downhole operation, such as in the drill bit 100 of FIG. 1. To accomplish this, in some embodiments, the multilayer joint 302 may include the braze layer 208.

Unlike the multilayer joint 202 of FIG. 2, however, the multilayer joint 302 generally does not provide distinct and defined material layers. Rather, the multilayer joint 302 may be characterized as a "gradient" multilayer joint 302 generated by gradient layering of the material layers of one or more of the base layer 204, the intermediate layers 206, and the braze layer 208, such that the transition from one material to the next material is gradual instead of abrupt. As will be appreciated, gradient material layers in the gradient multilayer joint 302 may prove advantageous in providing a continuous change in CTE between the diamond table 124 and the substrate 120 rather than a step-wise change.

While the braze layer 208 is depicted in FIG. 3 as a defined or distinct material layer, the braze layer 208 may alternatively comprise a gradient layer that gradually transitions from the adjacent gradient intermediate layer 206. Moreover, in the illustrated embodiment, the base layer 204 (FIG. 2) may form an integral part of the intermediate layers 206. In other embodiments, however, the base layer 204 may comprise a defined material layer, and the braze layer 208 may instead form an integral part of the gradient intermediate layers 206. In yet other embodiments, both the base layer 204 and the braze layer 208 may form integral gradient parts of the gradient intermediate layers 206.

In the gradient multilayer joint 302, the material layers may be transitioned in mixtures or blends of two or more materials during the thin film deposition process used to form the gradient multilayer joint 302. As will be appreciated, the gradient multilayer joint 302 may provide an operator with the ability to vary chemical compositions and thereby design or tune the materials of the gradient multilayer joint 302 to a predetermined or designed gradient. Similar to the multilayer joint 202 of FIG. 2, the gradient multilayer joint 302 may be formed using any of the chemical or physical thin film deposition techniques listed herein. In some embodiments, the gradient multilayer joint 302 may be sequentially deposited directly on the diamond table 124 during the given thin film deposition process. Following the deposition process, the diamond table 124, with the gradient multilayer joint 302 deposited or otherwise formed thereon, may then be coupled to the substrate 120 to form cutter 300 through the brazing cycle. In other embodiments, however, the gradient multilayer joint 302 may be built up separate from the diamond table 124, such as on a carrier substrate positioned within the deposition chamber during the thin film deposition process. Following the deposition process, the gradient multilayer joint 302 may be detached from the carrier substrate as a free-standing multilayer film and subsequently positioned between the diamond table 124 and the substrate 120 to be subjected to the brazing cycle and thereby form the cutter 300.

Figure 4:
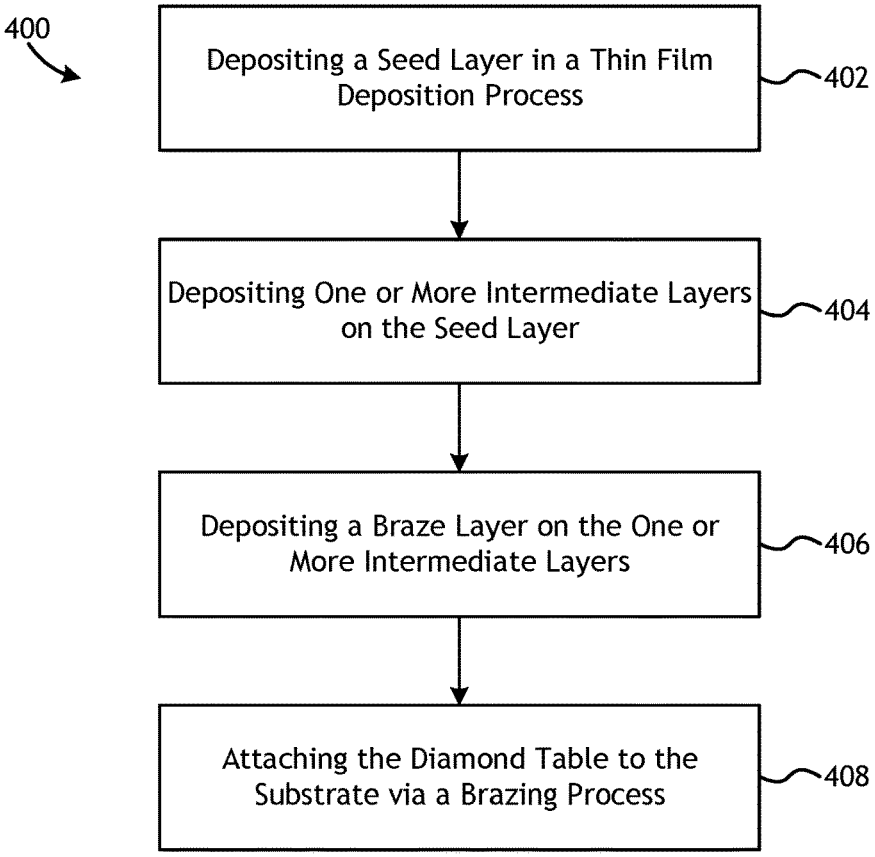
FIG. 4 is a schematic flowchart of a method of fabricating a cutter.

Referring now to FIG. 4, with continued reference to FIGS. 2 and 3, illustrated is a schematic flowchart of an exemplary method 400 of fabricating a cutter, according to one or more embodiments. The method 400 may prove useful in fabricating either of the cutters 200, 300 described herein. According to the method 400, a base layer may be deposited in a thin film deposition process, as at 402. In some embodiments, as indicated above, the base layer 204 may be deposited directly on the diamond table 124 during the deposition process. In other embodiments, however, the base layer 204 may be deposited on a carrier substrate. The material of the base layer 204 may be selected such that it forms a chemical bond and/or carbide with the diamond table 124 during a subsequent heating and/or brazing cycle. Moreover, the material of the base layer 204 may be selected to exhibit a CTE that matches or closely matches the CTE of the diamond table 124.

One or more intermediate layers may then be deposited on the base layer, as at 404. In some embodiments, the base layer 204 and the intermediate layer(s) 206 may be deposited in discrete or distinct layers of different materials. In other embodiments, however, the deposition transition from the material of the base layer 204 to the material of the intermediate layer(s) 206 (and between adjacent materials of multiple intermediate layers 206, if present) may be gradual, such that gradient layering of the materials may be achieved. In either case, the deposited material layers may prove useful in managing thermal stress, such as CTE between the diamond table 124 and the substrate 120. For instance, while the material for the base layer 204 may be selected to closely match the CTE of the diamond table 124, any subsequent materials of the intermediate layer(s) 206 may be selected to gradually transition the CTE closer to that of the substrate 120. In some embodiments, one or more of the base layer 204 and the intermediate layer(s) 206 may be doped and/or infiltrated during the deposition process to help manipulate or optimize the CTE. As a result, the deposited material layers may each exhibit a CTE that falls between that of the diamond table 124 and the substrate 120 to provide a transition between the two ends of the multilayer joint 202, 302.

The method 400 may continue by depositing a braze layer on the one or more intermediate layers, as at 406. The last layer or material of the intermediate layer(s) 206 may comprise a material (e.g., a metal or metal alloy) that may result in good adhesion to the material of the braze layer 208. Moreover, the material of the braze layer 208 may be selected such that the braze layer 208 forms a chemical bond with the substrate 120. One suitable material for the braze layer 208 is a silver-based braze alloy. Moreover, similar to the base layer 204 and the intermediate layer(s) 206, the braze layer 208 may be doped and/or infiltrated during the deposition process to help manipulate or optimize the CTE closer to that of the substrate 120. The diamond table 124 may then be attached to the substrate 120 via a brazing process with the multilayer joint 202, 302 positioned therebetween, as at 408.

Figure 5:
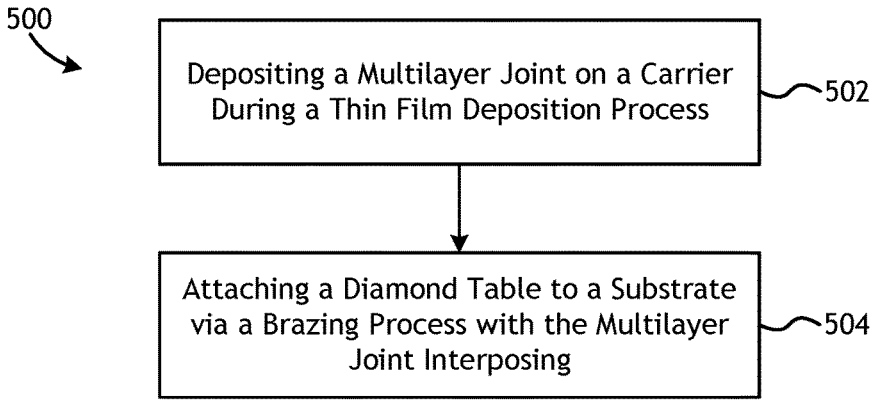
FIG. 5 is a schematic flowchart of another method of fabricating a cutter.

Referring now to FIG. 5, illustrated is a schematic flowchart of another method 500 of fabricating a cutter, according to one or more embodiments. Similar to the method 400, the method 500 may prove useful in fabricating either of the cutters 200, 300 described herein. According to the method 500, a multilayer joint may be deposited on a carrier during a thin film deposition process, as at 502. The carrier may be one of a diamond table and a carrier substrate, and the multilayer joint may include at least two component parts that include a base layer, one or more intermediate layers, and a braze layer. In some embodiments, a material of the at least two component parts may be doped with a dopant to alter a coefficient of thermal expansion of the material. The dopant may be selected from the group consisting of a ceramic, a metal, a polymer, and any combination thereof.

The method 500 may then include attaching the diamond table to a substrate via a brazing process with the multilayer joint interposing the diamond table and the substrate, as at 504. In cases where the carrier is the carrier substrate, the multilayer joint may first be detached from the carrier substrate and then positioned between the diamond table and the substrate for the brazing process. The brazing process of 504 may include vacuum brazing, hot pressing, and "lower" HPHT processes, without departing from the scope of the disclosure. The brazing process may occur after the diamond table has already been formed via an HTHP press cycle. Following the brazing operation, remaining catalyst materials in the diamond table, and any other materials that may be detrimental to the diamond table during drilling, may be leached from the diamond table to thermally stabilize the diamond table.

In cases where the carrier is the diamond table, the materials of the multilayer joint may be deposited on the carrier at a temperature lower than a graphitization temperature of the diamond table. This may prove advantageous in preventing graphitization of the diamond table. In some embodiments, depositing the multilayer joint on the carrier may include depositing one or more first materials on the carrier, and gradually transitioning a deposition of the one or more first materials to a deposition of one or more second materials on the carrier. This results in gradient layering of the material layers of the multilayer joint, which may prove advantageous in providing a continuous change in CTE between the diamond table and the substrate rather than a step-wise change. Moreover, the gradient layering may be doped and/or infiltrated with a material configured to optimize and otherwise manipulate the CTE between the diamond table and the substrate.

As mentioned above, the principles of the present disclosure are not limited to cutters, but can equally be applied to any polycrystalline diamond compact that has a diamond table attached to a substrate. For example, the principles of the present disclosure may be applied to diamond table bearing elements, such as those used in rolling cutter assemblies.

Figure 6:
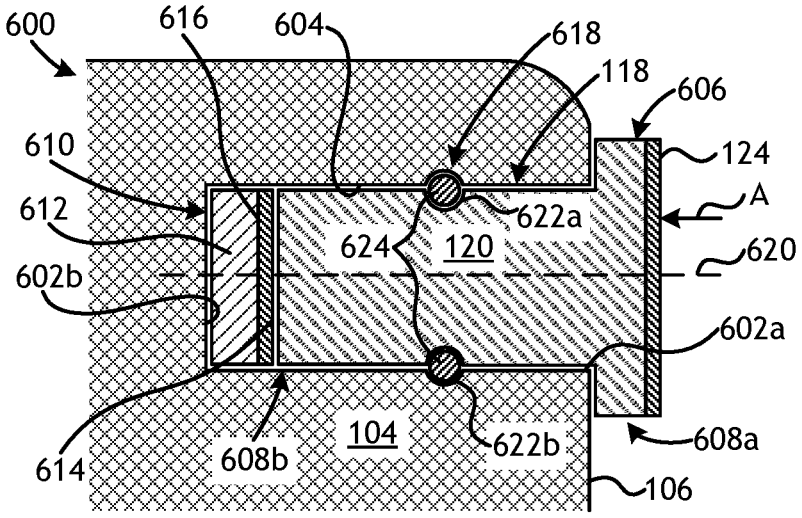
FIG. 6 is a cross-sectional top view of an exemplary rolling cutter assembly that employs a bearing element.

Referring to FIG. 6, illustrated is a cross-sectional top view of an exemplary rolling cutter assembly 600, according to one or more embodiments. The rolling cutter assembly 600 (hereafter "assembly 600") may be employed in the drill bit 100 of FIG. 1A and therefore may be best understood with reference thereto, where like numerals represent like components or elements not described again in detail. It should be noted, however, that while described herein as being used in conjunction with the drill bit 100, those skilled in the art will readily appreciate that the assembly 600 may equally be employed in a variety of other types of drill bits or cutting tools, without departing from the scope of the disclosure. For example, other cutting tools that may benefit from the embodiments described herein include, but are not limited to, impregnated drill bits, core heads, coring tools, reamers (e.g., hole enlargement tools), and other known downhole drilling tools.

As illustrated, the assembly 600 may be coupled to and otherwise associated with a blade 104 of the drill bit 100. In other embodiments, however, the assembly 600 may be coupled to any other static component of the drill bit 100, without departing from the scope of the disclosure. For instance, in at least one embodiment, the assembly 600 may be coupled to the top of a blade 104 of the drill bit 100 or in a backup row. The leading face 106 of the blade 104 faces in the general direction of rotation for the blade 104. A cutter pocket 118 may be formed in the blade 104 at the leading face of the blade 104. The cutter pocket 118 may include or otherwise provide a receiving end 602*a*, a bottom end 602*b*, and a sidewall 604 that extends between the receiving and bottom ends 602*a,b*.

The assembly 600 may further include a generally cylindrical rolling cutter 606 configured to be disposed within the cutter pocket 118. The rolling cutter 606 may be similar in some respects to the cutter 116 of FIG. 1B, such as including the substrate 120 and the diamond table 124 attached to the substrate 124. The receiving end 602*a* may define a generally cylindrical opening configured to receive the rolling cutter 606 into the cutter pocket 118. The substrate 120 may provide a first end 608*a* and a second end 608*b*. As illustrated, the first end 608*a* may extend out of the cutter pocket 118 a short distance, and the second end 608*b* may be configured to be arranged within the cutter pocket 118 at or near the bottom end 602*b*.

The assembly 600 may further include a bearing element 610 arranged within the cutter pocket 118 at the bottom end 602*b*. During operation of the drill bit that houses the rolling cutter 606 (e.g., the drill bit 100 of FIG. 1A), the second end 608*b* of the rolling cutter 606 (e.g., the substrate 120) may be configured to engage the bearing element 610 as the rolling cutter 606 rotates. In some embodiments, the bearing element 610 may be brazed into the bottom end 602*b* of the cutter pocket 118. In other embodiments, however, the bearing element 610 may be cast directly into the bottom end 602*b* of the cutter pocket 118. In at least one embodiment, the bearing element 610 may be secured into the bottom end 602*b* of the cutter pocket 118 by using a dovetail-like retention mechanism.

The makeup and construction of the bearing element 610 may be the same as the cutters 116 of FIG. 1B and as described herein above. More particularly, the bearing element 610 may include a substrate 612 (similar to the substrate 120) and a diamond table 614 (similar to the diamond table 124) may be attached to the substrate 612 using a multilayer joint 616 (similar to either of the multilayer joints 202, 302 of FIGS. 2 and 3). Accordingly, the bearing element 610 may be characterized and otherwise referred to herein as "a polycrystalline diamond compact." Moreover, the methods 400 and 500 of fabricating a cutter, as described above with reference to FIGS. 4 and 5, may be equally applicable to fabricating the bearing element 610, without departing from the scope of the disclosure.

The assembly 600 may further include a retention mechanism 618 configured to secure the rolling cutter 606 within the cutter pocket 118. The retention mechanism 618 may be any device or mechanism configured to allow the rolling cutter 606 to rotate about its central axis 620 within the cutter pocket 118 while simultaneously preventing removal thereof from the cutter pocket 118. In some embodiments, as illustrated, the retention mechanism 618 may comprise a ball bearing system that includes an inner bearing race 622*a*, an outer bearing race 622*b*, and one or more ball bearings 624 (two shown) disposed within the inner and outer bearing races 622*a,b*. The inner bearing race 622*a* may be defined on the outer surface of the rolling cutter 606 (i.e., the outer surface of the substrate 120), and the outer bearing race 622*b* may be defined on the inner radial surface of the sidewall 604 of the cutter pocket 118.

In exemplary drilling operation, the rolling cutter 606 may be configured to engage an underlying subterranean formation. As the rolling cutter 606 contacts the underlying formation, the formation begins to shear and generates an opposing force that is assumed on the diamond table 214 in the direction A. Moreover, shearing of the formation may urge the rolling cutter 606 to rotate about the central axis 620. The opposing force in the direction A may be transmitted to the second end 608*b* of the rolling cutter 606 (e.g., the substrate 120), which engages the bearing element 610. Since the bearing element 610 is made of an ultra-hard material, such as TSP, the second end 608*b* may slidingly engage the bearing element 610, without which, the second end 608*b* could potentially gall the bottom end 602*b* end of the cutter pocket 118. With the bearing element 610, however, friction between the cutter pocket 118 and the second end 608*b* of the rolling cutter 606 may be dramatically reduced, thereby also decreasing the amount of heat generated during drilling. As a result, it will require less force to urge the rolling cutter 606 to rotate, and a drilling operator may be able to apply more force against the rolling cutter 606 in the direction A, and thereby increase the efficiency of the drilling operation.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A polycrystalline diamond compact, comprising:

a substrate;

a diamond table attached to the substrate; and a multilayer joint interposing the substrate and the diamond table, the multilayer joint comprising at least two component parts selected from the group consisting of a base layer, one or more intermediate layers, and a braze layer, wherein the at least two component parts are formed via a thin film deposition process;

wherein at least one of the at least two component parts is doped with a material to alter a coefficient of thermal expansion, the material being selected from the group consisting of a ceramic, a metal, a polymer, and any combination thereof.

2. The polycrystalline diamond compact of claim 1, wherein the diamond table is made of an ultra-hard material selected from the group consisting of polycrystalline diamond, polycrystalline cubic boron nitride, impregnated diamond, thermally stable polycrystalline diamond, and any combination thereof.

3. The polycrystalline diamond compact of claim 1, wherein the diamond table is formed by a high-temperature, high-pressure (HTHP) press cycle.

4. The polycrystalline diamond compact of claim 3, wherein the diamond table is leached to become thermally stable following the HTHP press cycle.

5. The polycrystalline diamond compact of claim 3, wherein the diamond table is attached to the substrate by at least one of a brazing process, hot pressing, and a lower high-temperature, high-pressure (HTHP) press cycle.

6. The polycrystalline diamond compact of claim 1, wherein the thin film deposition process is selected from the group consisting of physical vapor deposition, chemical vapor deposition, sputtering, pulsed laser deposition, chemical solution deposition, plasma enhanced chemical vapor deposition, cathodic arc deposition, electrohydrodynamic deposition, ion-assisted e-beam deposition, plating, thermal evaporation, and spin coating.

7. The polycrystalline diamond compact of claim 1, wherein the at least two component parts comprise a material selected from the group consisting of titanium, tungsten, chromium, zirconium, manganese, silver, copper, gold, vanadium, yttrium, niobium, molybdenum, hafnium, tantalum, nickel, palladium, boron, silicon, iron, aluminum, cobalt, indium, phosphorus, and any alloy thereof.

8. The polycrystalline diamond compact of claim 1, wherein the at least two component parts comprise materials that exhibit corresponding coefficients of thermal expansion that lie between that of the diamond table and the substrate.

9. The polycrystalline diamond compact of claim 1, wherein the multilayer joint is a gradient multilayer joint where materials of the at least two component parts gradually transition from one or more first materials to one or more second materials.

10. The polycrystalline diamond compact of claim 1, wherein the polycrystalline diamond compact comprises a cutter or a bearing element.

11. A method of fabricating a polycrystalline diamond compact, comprising:

depositing a multilayer joint on a carrier during a thin film deposition process, the carrier being one of a diamond table and a carrier substrate, and the multilayer joint including at least two component parts selected from the group consisting of a base layer, one or more intermediate layers, and a braze layer;

attaching the diamond table to a substrate via a brazing process with the multilayer joint interposing the diamond table and the substrate; and doping a material of the at least two component parts with a dopant to alter a coefficient of thermal expansion of the material, the dopant being selected from the group consisting of a ceramic, a metal, a polymer, and any combination thereof.

12. The method of claim 11, wherein depositing the multilayer joint on the carrier is preceded by:

forming the diamond table via a high-temperature, high-pressure (HTHP) press cycle; and leaching a catalyst from the diamond table following the HTHP press cycle.

13. The method of claim 11, wherein the carrier is the carrier substrate attaching the diamond table to the substrate comprises:

detaching the multilayer joint from the carrier substrate; and positioning the multilayer joint between the diamond table and the substrate for the brazing process.

14. The method of claim 11, wherein depositing the multilayer joint on the carrier comprises:

depositing one or more first materials on the carrier; and gradually transitioning a deposition of the one or more first materials on the carrier to a deposition of one or more second materials on the carrier.

15. The method of claim 11, wherein the carrier is the diamond table and depositing the multilayer joint on the carrier comprises depositing one or more materials at a temperature lower than a graphitization temperature of the diamond table.

* * * * *